US006513444B2

(12) United States Patent
Walker

(10) Patent No.: US 6,513,444 B2
(45) Date of Patent: Feb. 4, 2003

(54) MEDIA CASSETTE

(75) Inventor: Neil Walker, Perth (GB)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/951,745

(22) Filed: Sep. 11, 2001

(65) Prior Publication Data

US 2002/0029728 A1 Mar. 14, 2002

(30) Foreign Application Priority Data

Sep. 12, 2000 (GB) ..... 0022248

(51) Int. Cl.[7] ..... E05G 1/14; E05G 1/00; G08B 15/02

(52) U.S. Cl. ..... 109/25; 109/20; 109/29

(58) Field of Search ..... 109/20, 25, 29–34; 267/165; 220/578, 579, 554; 206/449, 451

(56) References Cited

U.S. PATENT DOCUMENTS 4,189,131 A * 2/1980 McCabe ..... 267/151
5,156,272 A 10/1992 Bouchard et al.
5,209,395 A * 5/1993 Zouzoulas et al. ..... 109/45
5,537,938 A * 7/1996 Lopez, Jr. ..... 109/25
5,598,793 A * 2/1997 Lopez, Jr. ..... 109/25
6,402,025 B1 * 6/2002 Shepherd et al. ..... 235/379

* cited by examiner

*Primary Examiner*—Anthony Knight
*Assistant Examiner*—Michael J. Kyle

(57) ABSTRACT

A media cassette (10) including a fluid spray system for spraying media located within the cassette (10) is described. The cassette (10) includes a lid (12) and a body (14). The body (14) includes an absorbent portion (40) in the form of a chemical absorbing sheet for absorbing any fluid not absorbed by the media (42). The sheet (40) is preferably folded and creased into a concertina arrangement so that the sheet (40) can expand and compress as media are removed from or added to the cassette (10). If the fluid spray system is activated when the cassette (10) is only partially full of media (42), then the sheet (40) absorbs the fluid that is not absorbed by the media (42), thereby preventing leakage of the fluid from the cassette (10).

10 Claims, 3 Drawing Sheets

MEDIA CASSETTE

BACKGROUND OF THE INVENTION

The present invention relates to a media cassette. In particular, the invention relates to a currency cassette for use in an automated teller machine (ATM), where the cassette includes a fluid system for staining currency in the event of unauthorized access to the ATM.

ATMs dispense banknotes to users in an unattended environment. The banknotes are stored in a safe within the ATM to guard against theft of the banknotes. The banknotes are typically stored in currency cassettes. One advantage of using cassettes is that banknotes can be pre-arranged in a neat order, thereby minimizing the space required for storing the banknotes. Another advantage of using cassettes is that they allow easy replenishment of banknotes in an ATM, because an empty (or nearly empty) cassette can be removed and a full cassette inserted in its place. This also eases problems in transporting banknotes and in reconciling the number of banknotes dispensed by an ATM with the number of banknotes left in the ATM's cassettes.

To avoid theft of these currency cassettes, some cassettes include a fluid spray system for staining the banknotes stored in the cassette. Typically, an ink dye is stored either outside or inside the cassette, and there are sensors associated with the cassette to detect tampering with the cassette or with a container in which the cassette is mounted. In use, cassettes are mounted in an ATM's pick module within a safe; when being transported by a cash-in-transit company, the cassettes are mounted within a storage rack. Both the storage rack and the safe include sensors that may detect: forcing the container (the safe or the storage rack) door open, drilling through a wall of the safe or rack (that is, penetrating the container), explosions, tilting the safe or rack, and such like. If one of these sensors is activated, then the dye is sprayed over the contents of the cassette with a high pressure jet.

The dye stains the banknotes, so that if anyone attempts to use the stained banknotes to make a purchase, it is evident that the banknotes have been obtained illegitimately.

If the fluid system is activated when the cassette is full or nearly full of banknotes then the banknotes absorb all of the ink. However, if the system is activated when the cassette is nearly empty, then there are not enough banknotes to absorb the ink that is sprayed. This excess ink flows within the cassette and leak outs of the cassette and into the ATM safe. The dye used can be harmful if inhaled, and may also corrode or otherwise harm the cassette and any part of the ATM that the dye leaks onto, for example power cables and harnessing.

The amount of ink used (typically 300 ml) cannot be decreased, however, because this amount of ink is required when the cassette is full of banknotes, otherwise not all of the banknotes would be stained by the ink.

SUMMARY OF THE INVENTION

It is among the objects of an embodiment of the invention to obviate or mitigate the above disadvantage or other disadvantages associated with currency cassettes.

According to a first aspect of the invention there is provided a media cassette including a fluid spray system for spraying media located within the cassette, characterized in that the cassette includes an absorbent portion for absorbing any fluid not absorbed by the media.

Preferably, the absorbent portion is in the form of a sheet.

Preferably, the absorbent portion is compressible, so that when the cassette is full of media the absorbent portion is small, and as media is removed from the cassette the absorbent portion expands.

Preferably, the absorbent portion has a greater surface area than any surface of the cassette.

The absorbent portion may be resiliently compressible.

Preferably, the absorbent portion is located between a media guide for urging the media to a pick area at one side of the cassette, and the opposite side of the cassette to the pick area (the non-picking side).

Preferably, the absorbent portion is coupled to the media guide and the non-picking side, so that as the media guide moves towards the pick area, the absorbent portion is pulled by the media guide. This has the added advantage that the absorbent portion is located on an opposite side of the media guide to the pick area, thereby ensuring that the absorbent portion does not come into contact with a pick unit located in an ATM. This avoids contamination of the pick unit.

In some embodiments, where a dye is used that does not degrade the cassette, the absorbent portion may be removably coupled so that if the fluid system is activated and the absorbent portion absorbs ink, the absorbent portion can be easily and safely removed from the cassette and replaced with a new absorbent portion.

Preferably, the absorbent portion is creased and folded into a concertina arrangement. To absorb all of the excess dye, it has been found that a surface area greater than that of the bottom surface of the cassette is required. By using a concertina arrangement, a greater surface area can be produced than if a flat sheet was used. Another advantage of the concertina arrangement is that when the media guide is retracted to replenish the cassette with media, the absorbent portion will fold neatly into a compressed concertina shape.

Preferably, the absorbent portion and the media within the cassette cover substantially the entire length of the cassette when the cassette is in use, so that as media is removed the absorbent portion extends, and as media is inserted the absorbent portion contracts.

In other embodiments, the absorbent portion may be located on one or more of the sidewalls and/or the bottom surface of the cassette.

By virtue of this aspect of the invention, a media cassette is provided that absorbs all of the dye ejected by a fluid spray system regardless of how much media is stored in the cassette (that is, regardless of how full or empty the cassette is). The cassette can be re-used any times without having to change the absorbent portion (unless the fluid system is activated). By having a resiliently compressible absorbent portion, the absorbent portion automatically expands and contracts as media is removed and inserted into the cassette. In those embodiments where the fluid does not degrade the cassette, by having a disposable absorbent portion, cleaning the cassette after activation of the fluid spray system is simplified.

This aspect of the invention has the following advantages. It reduces the vapor levels in an ATM storing the cassette (because the dye is contained within the cassette), so that it is easier and safer to clean. The risk of dye leaking out of the cassette is reduced because the excess dye is absorbed. The dye is contained within the cassette, thereby minimizing the area to be cleaned. The dye is absorbed by a disposable absorbent sheet, so it is easy to remove the dye by removing the stained sheet.

According to a second aspect of the invention there is provided an absorbent portion for use in a media cassette including a fluid spray system for spraying media located within the cassette, where the portion is configured to fit within the cassette, and has a surface area greater than that of a bottom surface of the cassette.

BRIEF DESCRIPTION OF THE DRAWINGS

An embodiment of the present invention will now be described, by way of example, with reference to the accompanying drawings, in which.

DETAILED DESCRIPTION

Figure 1:
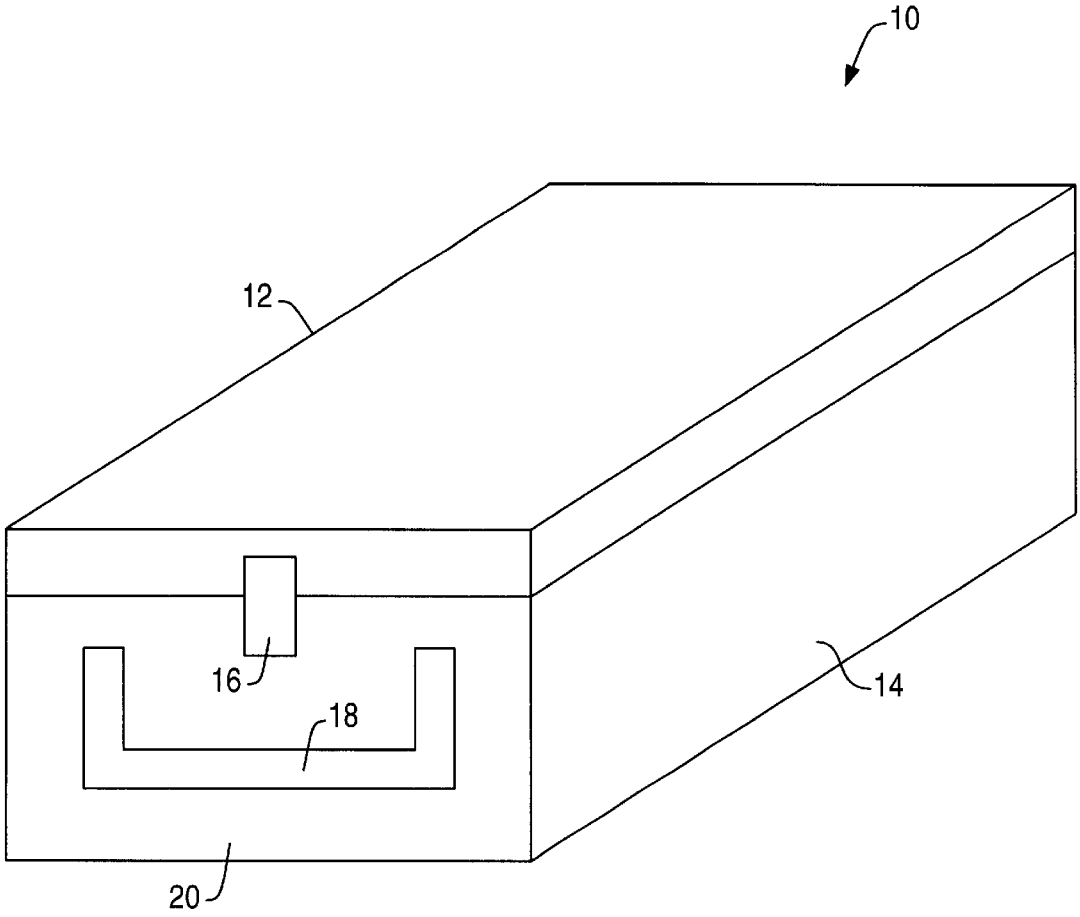
FIG. 1 is a schematic diagram of a currency cassette according to one embodiment of the present invention.
Figure 2:
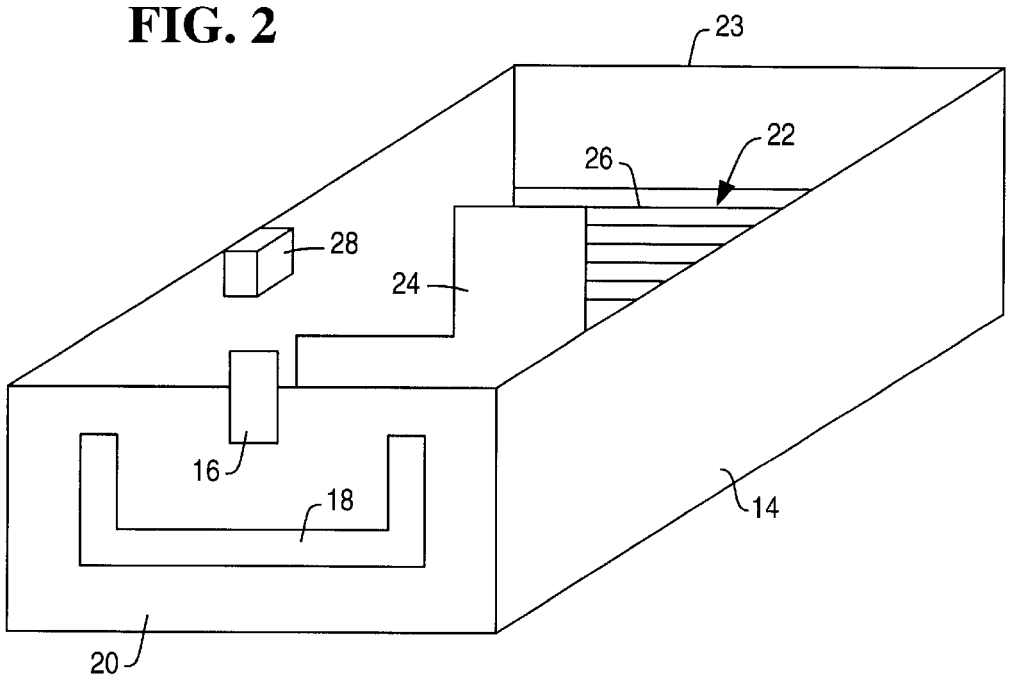
FIG. 2 is a schematic diagram of a body portion of the currency cassette of FIG. 1.
Figure 3:
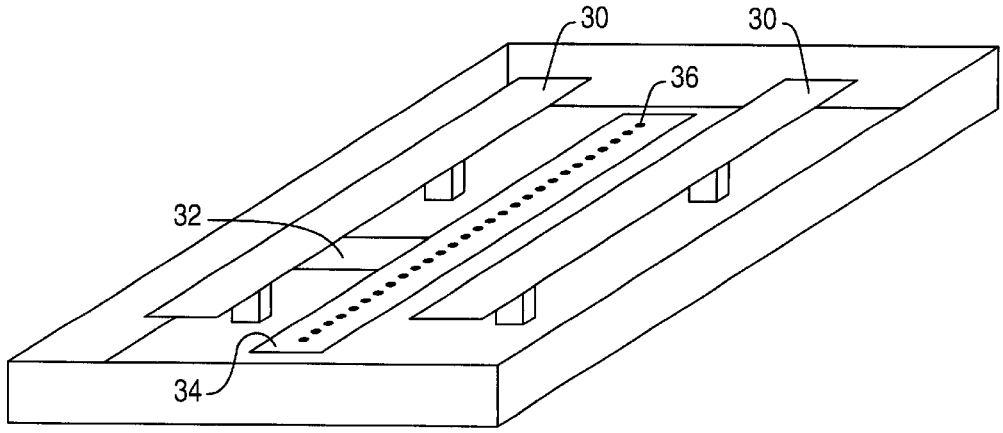
FIG. 3 is a schematic diagram of the underside of a lid portion of the currency cassette of FIG. 1.

Referring to FIGS. 1 to 3, a media cassette 10 in the form of a polycarbonate currency cassette for storing banknotes has a lid 12 secured to a body 14 by a latch 16. The body 14 has a handle 18 at a handle end 20, and a pick area 22 at the opposite end 23. Mounted on a ratchet within the body 14 is a biased note guide 24 that urges banknotes towards the pick area 22. The body 14 has a roller shutter 26 covering the pick area 22, so that when the cassette 10 is inserted into an ATM (not shown) tines in the ATM engage with recesses (not shown) in the body 14, and the roller shutter 26 is automatically raised by the tines to allow banknotes to be picked from the pick area 22. The body 14 also has an dye transfer channel 28 for conveying dye from an external cartridge (not shown) typically located in an ATM's pick module, into the lid 12.

The underside of the lid 12 includes two banknote aligners 30 that prevent banknotes stored within the cassette 10 from moving towards the lid 12 during transportation. The underside of the lid 12 also includes a dye transfer channel 32 and a spray bar 34 having a plurality of apertures 36 for spraying dye into the body 14.

The dye transfer channels 28, 32 and the spray bar 34 comprise a conventional fluid spray system.

Figure 4:
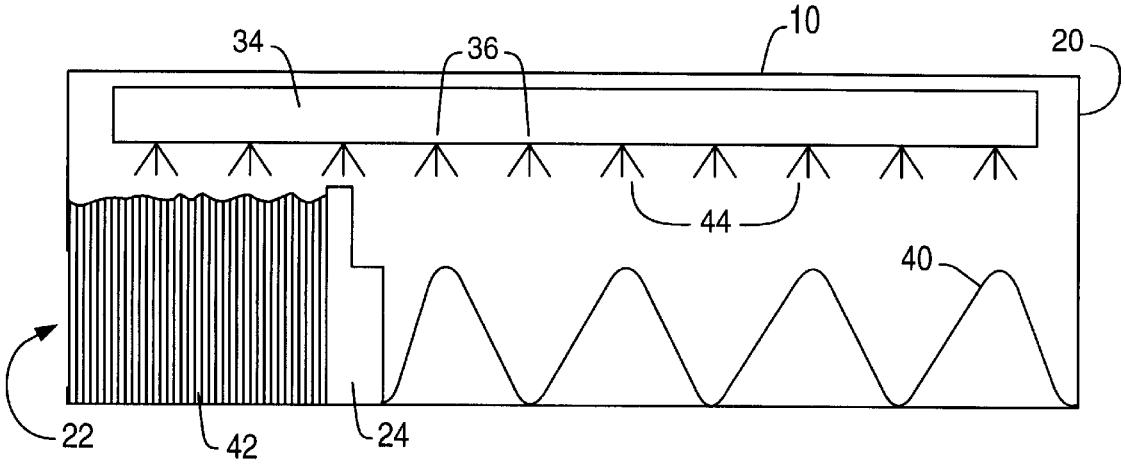
FIG. 4 is a simplified schematic sectional view of the cassette of FIG. 1.

Referring now to FIG. 4, which is a simplified schematic sectional view through the middle of the cassette 10 of FIG. 1, an absorbent portion 40 in the form of an absorbent sheet is creased and folded in a concertina style. This sheet 40 is a chemical absorbent sheet available from RS Components UK, PO Box 99, Corby, Northants, NN17 9RS, as part number RS 711-873. One end of the sheet 40 is coupled to the note guide 24, the opposite end of the sheet 40 is coupled to the handle end 20. The coupling is implemented by a hook and loop fastener arrangement in this embodiment so that the sheet 40 can be easily removed and replaced.

Figure 5:
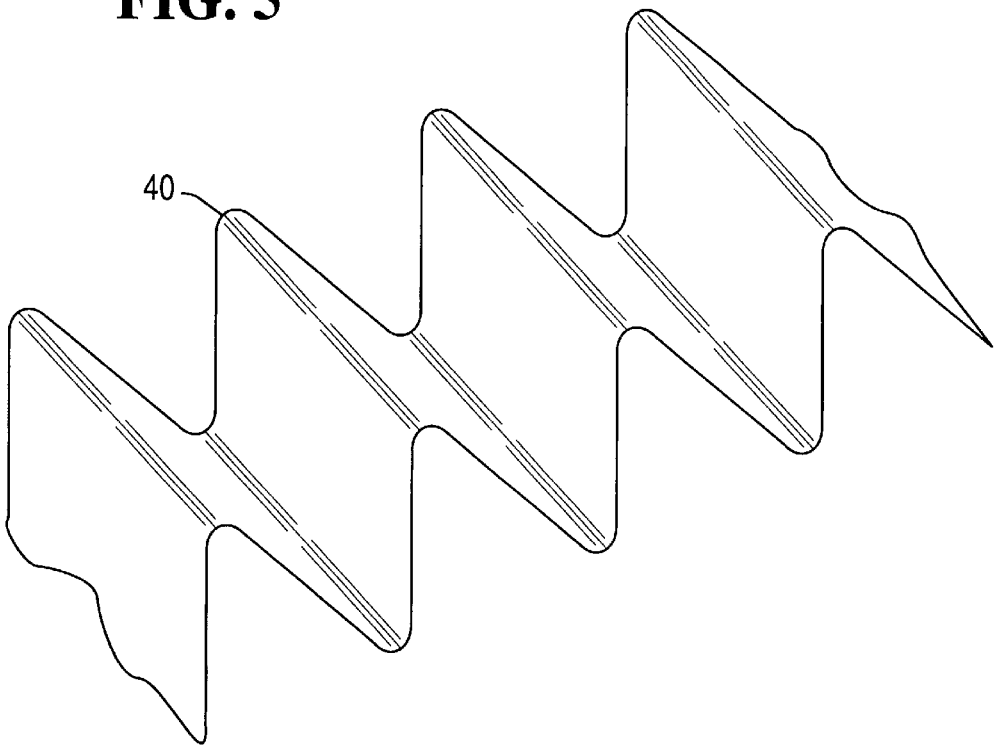
FIG. 5 is a perspective view of an absorbent portion used in the cassette of FIG. 1.

FIG. 5 is a perspective view of the sheet 40 in its extended form.

As banknotes 42 are picked from the cassette 10, the note guide 24 moves towards the pick area 22 and pulls the sheet 40 with it, thereby expanding the sheet 40. If the fluid system is activated when comparatively few banknotes 42 are present, as illustrated in FIG. 4 by miniature sprays 44 from apertures 36, the banknotes 42 absorb some of the dye, but the dye that is sprayed over the sheet 40 is absorbed by the sheet 40, thereby ensuring that all the dye is absorbed, either by the banknotes 42 or by the sheet 40, thereby containing all the dye within the cassette 10 and making cleaning of the ATM in which the cassette 10 is mounted cleaner and safer, and ensuring that the pick module within the ATM would not need replacing.

If the cassette 10 needs to be replenished and the fluid spray system has not been activated (because the cassette 10 was not tampered with), then the note guide 24 can be retracted to allow more banknotes 42 to be inserted, and the sheet 40 compresses in a concertina style ready for another use.

Various modifications may be made to the above described embodiment within the scope of the invention, for example, in other embodiments, media other than banknotes may be used, for example, tickets, coupons, checks, and such like. In other embodiments, the coupling between the sheet and the media guide and between the sheet and the cassette sidewall may be implemented by pins, rivets, tape, or some other convenient coupling mechanism. In other embodiments, the sheet may have a shape other than a concertina arrangement.

What is claimed is:

1. A media cassette comprising:

a fluid spray system for spraying media located within the cassette; and an absorbent portion for absorbing any fluid unabsorbed by the media, the absorbent portion is compressible, so that when the cassette is full of media the absorbent portion is small, and as media is removed from the cassette the absorbent portion expands.

2. A media cassette comprising:

a fluid spray system for spraying media located within the cassette; and an absorbent portion for absorbing any fluid unabsorbed by the media, the absorbent portion is located between a media guide for urging media to a pick area at one side of the cassette, and the opposite side of the cassette to the pick area, the absorbent portion is coupled to the media guide and a side opposite the pick area, so that as the media guide moves towards the pick area, the absorbent portion is pulled by the media guide.

3. A media cassette comprising:

a fluid spray system for spraying media located within the cassette; and an absorbent portion for absorbing any fluid unabsorbed by the media, the absorbent portion is located between a media guide for urging media to a pick area at one side of the cassette, and the opposite side of the cassette to the pick area, the absorbent portion is resiliently compressible and urges against the side opposite the pick area and the media guide, so that the portion expands as the media guide moves towards the pick area.

4. A cassette according to claim 2, wherein the absorbent portion is removably coupled so that if the fluid system is activated and the absorbent portion absorbs ink, then the absorbent portion can be easily and safely removed from the cassette and replaced with a new absorbent portion.

5. A media cassette comprising:

a fluid spray system for spraying media located within the cassette; and an absorbent portion for absorbing any fluid unabsorbed by the media, the absorbent portion is creased and folded into a concertina arrangement.

6. A media cassette comprising:

a fluid spray system for spraying media located within the cassette; and an absorbent portion for absorbing any fluid unabsorbed by the media, the absorbent portion is located at the bottom of the cassette beneath any media stored in the cassette.

7. A media cassette comprising:

actuatable spraying means for, when actuated, spraying media located within the cassette; and absorbing means for absorbing fluid unabsorbed by media when the spraying means is actuated, the absorbent means comprises a compressible sheet of material which is compressed when the cassette is full of media and which expands when media is removed from the cassette.

8. A media cassette comprising:

actuatable spraying means for, when actuated, spraying media located within the cassette; and absorbing means for absorbing fluid unabsorbed by media when the spraying means is actuated, the absorbing means is disposed at the bottom of the cassette.

9. A media cassette comprising:

a sprayer for spraying fluid onto media located within the cassette; and a removable sheet of absorbable material disposed within the cassette and for absorbing fluid unabsorbed by media, the sheet of material comprises a corrugated shape.

10. A media cassette comprising:

a sprayer for spraying fluid onto media located within the cassette; and a removable sheet of absorbable material disposed within the cassette and for absorbing fluid unabsorbed by media, the sheet of material is disposed at the bottom of the cassette.

* * * * *